United States Patent [19]

Pässler et al.

[11] Patent Number: 4,559,243

[45] Date of Patent: Dec. 17, 1985

[54] ABSORBENT PLANAR STRUCTURE AND METHOD OF ITS MANUFACTURE

[75] Inventors: Michel Pässler, Neusäss; Bruno Reisch, Augsburg, both of Fed. Rep. of Germany

[73] Assignee: Firma Carl Freudenberg, Weinheim, Fed. Rep. of Germany

[21] Appl. No.: 402,350

[22] Filed: Jul. 27, 1982

[30] Foreign Application Priority Data

Oct. 14, 1981 [DE] Fed. Rep. of Germany ..... 3140784

[51] Int. Cl.[4] ..... B05D 1/00

[52] U.S. Cl. ..... 427/209; 264/45.3; 427/244; 427/246; 427/381; 428/253; 428/492

[58] Field of Search ..... 428/318.4, 319.1, 317.9, 428/319.3, 319.7, 254, 290, 95, 253, 492; 427/209, 244, 246, 373, 381; 264/45.3, 45.8, 46.7, 46.4, 50

[56] References Cited

U.S. PATENT DOCUMENTS 2,832,997 5/1958 Bristol ..... 264/50

3,281,258 10/1966 Callahan ..... 264/50

3,311,115 3/1967 Mueller et al. ..... 264/50

3,657,035 4/1972 Politzer et al. ..... 428/317.9

4,130,683 12/1978 Michel et al. ..... 428/317.9

*Primary Examiner*—James J. Bell

*Attorney, Agent, or Firm*—Kenyon & Kenyon

[57] ABSTRACT

The present invention provides for an absorbent planar structure or so-called "sponge cloth" as well as for the method of making such a structure. The absorbent planar structure itself is permeated with pores and comprises a latex-bonded fiber material optionally reinforced with a woven or knit material, a layer of known foamed plastic, non-woven fabric or abrasive fleece. The method for making such a structure dispenses with conventional pore formers and is characterized by forming a foam of the latex and fiber materials by use of a suitable gaseous medium. The foam thus obtained, after homogeneous mixing, is applied to a substrate and the fiber-containing latex foam is then coagulated by heat action, resulting in an open-pore structure which is stabilized by subsequent drying and vulcanization.

15 Claims, No Drawings

ABSORBENT PLANAR STRUCTURE AND METHOD OF ITS MANUFACTURE

FIELD OF THE INVENTION

The present invention relates to an absorbent planar structure and a method for its manufacture. More specifically, the present invention relates to an absorbent planar structure, permeated by pores and comprising a latex-bonded fiber material which is optionally reinforced with a woven or knit material, a layer of known foamed plastic, non-woven fabric or abrasive fleece.

BACKGROUND OF THE INVENTION

Absorbent planar structures are well-known as wiping cloths for household use. Because of their absorbency, they may be called "sponge cloth". Various kinds of sponge cloth are known, the most popular variety being the viscose sponge cloth. Other kinds include rubber or polyurethane sponge cloths which have achieved no parctical significance. In addition to the above-mentioned sponge cloths, there also exist sponges and window cloths made of cross-linked polyvinyl alcohol, which are used to a small extent. All the above-described products, especially the cloths or sponges containing cross-linked polyvinyl alcohol, are hard and brittle in their dry state.

As already mentioned, the so-called viscose sponge cloth is in common use. Such cloth often contains a woven fabric in order to increase its tear strength. Since it is also hard and brittle in its dry state, viscose sponge cloth may be impregnated with a dilute softener solution, e.g., glycerin, in order to eliminate its stiff feel. Viscose sponge cloth without such a softener additive cannot withstand any mechanical stress in an absolutely dry condition. Also of note is the fact that cloth without a softener absorbs only about 10% moisture when climatized, while a "softened" cloth absorbs about 20% moisture. Thus, in use, a softened cloth which has been merely air-dried may be subjectively perceived as dry but in fact will still contain 15 to 20% moisture. The result is that the cloth does not become completely brittle. Despite the softening, the cloth's feel is still not soft and pleasant, nor can the waviness of the cloth material be completely eliminated. Rather, as it dries, the cloth will tend to arch mainly at the corners such that planar contact is no longer maintained. For the above-stated reasons, the viscose sponge cloth is usually packaged moist so as to avoid such problems. However, this poses hygienic problems associated with bacterial and fungal growth, which may require the addition of bactericides and fungicides.

"Softening" with glycerin or other water-soluable substances is also highly disadvantageous because the "softeners" are washed out during use so that the originally soft sponge cloths become hard and stiff again when dry. Therefore, although softened cloths may have the advantage of a high absorption rate and great water absorbing capability, as well as a pleasant feel in a moist condition, such advantages are countervailed by the disadvantage of poor durability, especially at the surface. Wiping until dry is not possible, and in spite of being packaged with softeners, the cloth, when in dry condition, becomes hard and stiff again with use. And, of course, the danger of bacterial and fungal growth must always be reckoned with. Moreover, when such softened cloths are manufactured according to the well-known cellulose xanthogenate method, more or less severe environmental pollution results.

As a consequence of the above-described state of the art, it is an object of the present invention to provide an absorbent planar structure which absorbs great amounts of water quickly without the known disadvantages associated with the viscose sponge cloth. A cloth produced according to the present invention should be soft and have a pleasant feel even in its dry state. It also should not exhibit bacterial and fungal growth. Furthermore, cloth according to the present invention is characterized by the fact that softeners, pore formers or similar substances which interfere with and change the properties of the cloth during use, are eliminated. Also, it is an object of the present invention to provide an environmentally safe method of producing novel "sponge cloths" of the present invention.

The above-cited objectives are satisfied by the absorbent planar structure, and method of manufacturing same, as are described in the accompanying claims.

SUMMARY OF THE INVENTION

The present invention provides for an absorbent planar structure or so-called "sponge cloth" as well as for the method of making such a structure. The absorbent planar structure itself is permeated with pores and comprises a latex-bonded fiber material optionally reinforced with a woven or knit material, a layer of known foamed plastic, non-woven fabric or abrasive fleece. The method for making such a structure dispenses with conventional pore formers and is characterized by forming a foam of the latex and fiber materials by use of a suitable gaseous medium. The foam thus obtained, after homogeneous mixing, is applied to a substrate and the fiber-containing latex foam is then coagulated by heat action, resulting in an open-pore structure which is stabilized by subsequent drying and vulcanization.

DETAILED DESCRIPTION OF THE INVENTION

The absorbent planar structure of the present invention contains a hydrophilic fiber material which is latex-bonded and permeated by essentially open pores. If reinforcement of the planar structure is desired, it is preferable to use a woven or knit material, a layer of known foamed plastic or a non-woven fabric which has been coated on one or both sides with latex-bonded fiber material. When only one side of the non-woven fabric has been coated, the fabric may also contain mineral abrasives so that the fabric side may produce a scouring effect when used.

The fiber material comprises a mixture of hydrophilic staple fibers of different lengths and, optionally, fiber dust, cellulose, mechanical wood pulp, linters or the like. Hydrophobic staple fibers of a synthetic material may be admixed with the hydrophilic fiber material in order to increase its mechanical strength. The fiber-mix is then embedded in an open-pore foam, preferably comprising a heat-coagulating latex. The foamed latex is prepared without the addition of any salts or other pore formers. Rather, the latex is foamed by means of introducing a suitable gaseous medium, preferably air. The ratio of fiber to latex is in the range of 80:20 to 10:90 percent by weight, preferably between 70:30 and 40:60.

According to a preferred embodiment of the method of the present invention, the fiber material of the above-described mix, is mixed first with the latex mixture in aqueous suspension, and subsequently foamed with air.

The foam thus produced may then be applied to a textile reinforcing substrate where it is coagulated by the application of heat. Then, the fiber-latex structure together with the substrate is dried to obtain a coherent structure.

The planar structure according to the present invention distinctly differs from previously known viscose sponge cloths, both with respect to constituent raw materials and to production method. Whereas viscose sponge cloth is produced via the cellulose xanthogenate method, utilizing salts such as sodium sulfate as pore formers, the material of the present invention can be produced without pore formers. Rather, the composition is foamed only with air. The latex foam thus formed is coagulated by application of heat and this coagulated foam is vulcanized or cross-endeed during or after the drying operation.

The fiber mixture, together with an optional wetting agent, is present in an aqueous fiber suspension in a amount equal to 5 to 30% by weight of the suspension's total weight. Usually, a 10-weight percent suspension is preferred. The latex mixture, either foamed or unfoamed, may then be admixed with the foam prepared from the fiber suspension. It is advisable to use latex mixtures that are adjusted to be heat-sensitive so that, after applying them to the reinforcement material, they can be coagulated by the application of heat. The planar structure thus formed is dried and subsequently vulcanized or cured.

The feel of the "sponge cloth" prepared according to the present invention is soft in its dry state, therefore the cloth can be packaged dry without utilizing disturbing additives such as water and softeners which are typically used in packaging viscose sponge cloths. As a consequence of such additives being eliminated, cloths of the present invention do not have the hygienic drawbacks of viscose sponge cloths which are packaged moist and thus encourage attack by bacteria or fungi.

The sponge cloth of the present invention is essentially open-pored. The cell walls are heavily perforated and there are bigger cavities than are observed in the viscose sponge cloth. In structure, the product of the present invention greatly resembles natural sponge with its dense maze of fibrils and expansive cavities.

While the basic constitutent material of the viscose sponge cloth is entirely hydrophilic, the constituent material of the product of the present invention may have hydrophilic properties due to the fibers therein, and hydrophobic properties due to the latex. The new cloth herein disclosed is soft and resilient in dry condition, the resiliency remaining essentially intact when it is moist. When wetted, which happens very quickly, the material of the present invention will absorb an amount of water equal to several times its own weight.

As mentioned before, the fiber/latex ratio is between 80:20 and 10:90 percent by weight. Hydrophilic, absorbent fibers suitable for use in the present invention include viscose fibers cut short to a fiber length of about 2 to 16 mm, as well as cellulose, viscose fiber powder, cotton powder, linters, mechanical wood pulp, polyvinyl alcohol fibers and mixtures of the aforementioned. It is recommended as a rule that the following fiber weight-percentages, based on the total weight of the fiber mixture be observed: up to 100 weight-percent viscose fiber powder; up to 100 weight-percent cotton powder, up to 50 weight-percent cellulose, plus 10 to 50 weight-percent viscose fiber shortcuts (1.7 to 22 dtex.). Shortcuts of a 5 to 8 mm fiber length are preferred. Suitable hydrophobic, synthetic shortcut fibers for use in the fiber mixture include polyamide, polyester, polypropylene and polyacrylonitrile fibers. The synthetic fibers are preferably added to the fiber mixture in an amount from 2 to 30 weight-percent. (All weight percentages are based on the total weight of the fiber mixture). Also, for better processability, it is preferred to add 0.5 to 2 weight-percent of a conventional wetting agent.

The latex mixture of the invention comprises the usual acrylates, methacrylates, polyurethanes, butadiene-acrylonitrile copolymers or butadiene-styrene copolymers. It is advisable to use heat-coagulating mixtures whose respective composition can be determined by simple pretrials.

The method of the present invention involves foaming a 10% -by-weight fiber suspension to a liter weight of 200 to 500 grams. To this foam is added the unfoamed or foamed latex mixture. The mixture of both fiber and latex components is then foamed to a preferred liter weight of 200 to 500 grams. Alternatively, one may mix together an unfoamed fiber suspension and an unfoamed or foamed latex mixture, subsequently foaming the combined components to a liter weight of 200 to 500 grams. The heat sensitivity of the mixture should be adjusted so that the coagulation point of the mixture preferably ranges between 30° and 60° C.

The foamed mixture may be applied to a reinforcing substrate of a woven or knit material, a layer of known foamed plastic or non-woven fabric, after which the foamed mixture is coagulated by the application and action of heat. A pattern may be embossed on the structure for ornamental purposes.

The fiber-latex structure so prepared is dried at about 130° C., after which it is vulcanized at, e.g., 150° C. The resulting cloth is then rinsed out and the majority of water is removed by squeezing or suction. Finally, the thus pre-dehydrated cloth is dried once more by the action of heat.

The substrate, which was coated on one or both sides with the foam mixture, remains in the finished sponge cloth as reinforcement. In the event that no reinforcing insert is desired, it is recommended that the foamed fiber and latex mixture be applied to a revolving metal or plastic belt. The foam can then be separated from the substrate after solidification (i.e. coagulation). A material resembling a sponge cloth without internal reinforcement is thus obtained.

Depending upon the chosen fiber mixture, which should be easily determinable by one skilled in the art, the hydrophilic properties of the cloth can be varied to meet the requirements of a given application. Further variation is possible by suitably choosing the latex. The latex of the present invention may comprise not only natural latex, but also synthetic latex of butadiene acrylonitrile, butadiene styrene and their many mixed polymerisates, together with other optional copolymers. In addition to the already-mentioned polyacrylates, polymethacrylates and their numerous copolymers, aqueous dispersions of polyurethanes are suitable also as the latex.

The following Examples serve to more fully explain the invention:

EXAMPLE 1

106 g butadiene acrylonitrile latex with a solids content of 47% by weight is adjusted with conventional additives (sulfur, zinc oxide, vulcanization accelerators, organopolysiloxanes among others) for heat sensitivity (coagulation point 55° to 60° C.) and foamed to twice the volume. Mixed with the foam are 350 g of a 10% by weight viscose fiber powder/cotton suspension (ratio 1:1) and the entire mixture foamed to a final volume of 1100 ml. The foam compound is applied to a textile substrate (viscose non-woven fabric 50 g/m$^2$), coagulated, and dried at 130° C. Subsequent vulcanization is performed at 150° C. The material thus produced is soft and has closely adjacent pores approximately 0.5 to 1 mm in diameter. The material absorbs an amount of water several times its own weight.

EXAMPLE 2

106 g butadiene acrylonitrile latex with a solids content of 47% by weight is adjusted with conventional additives (as in Example 1) for heat sensitivity (coagulation point 55° to 60° C.) and foamed to twice the volume. 200 g of a 10%-by-weight cellulose suspension containing a wetting agent are admixed to obtain 650 ml foam compound. The compound is applied to a non-woven viscose fiber fabric weighing 50 g/m$^2$, coagulated, dried at 130° C., and vulcanized at 150° C. After rinsing, drying is repeated. A heavy material of very good strength results. The more stratified structure has pores differing greatly in size from about 0.5 to 4 mm diameter. With this material table surfaces and wash basins can be wiped until dry.

EXAMPLE 3

The latex foam produced as in Example 2 is mixed with 400 g of a foam obtained by foaming a 10%-by-weight suspension of 75 weight percent cellulose and 25 weight percent fiber powder composed of 50 weight percent viscose fiber powder and 50 weight percent cotton powder, water, and wetting agent. 1700 ml foam are obtained. The foam compound is applied approximately 2.5 mm thick to a non-woven viscose fiber fabric weighing about 50 g/m$^2$, coagulated at 55° C., and predried at 130° C. The reverse side of the non-woven fabric is treated in the same manner, whereupon the product is vulcanized at 150° C. and subsequently rinsed out and dried again. The pores of the material are separated by very thin material layers, resulting in a very loose structure and in a soft feel.

EXAMPLE 4

142 g of a polybutadiene acrylonitrile latex with a solids content of 42% by weight and a weight of 475 g/l are mixed with a foam obtained by foaming a 10 weight percent viscose fiber powder/cotton powder suspension (1:1 weight ratio). The foam compound is applied to a 2 mm-thick layer of known foamed plastic substrate, coagulated at 50° C., and provided with a pattern by embossing. After predrying, the reverse side is coated also, coagulated at 50° C., and likewise provided with a pattern. After drying and vulcanizing at 140° and 160° C., respectively, the material is rinsed out and dehydrated mechanically by squeezing. The weight per unit of area of the very soft, resilient cloth is very low (289 g/m$^2$).

EXAMPLE 2

180 g of a polybutadiene acrylonitrile latex mixture with a solids content of 35.5 percent by weight including 10 g chalk are foamed to 350 ml. 17.5 g cotton powder, 8.8 g bleached cellulose and 15.1 g 5.6/6 (58%) viscose fibers cut short are brought to a foam volume of 1200 ml with 330 g water and 25 g oleoyl methyltauride as the wetting agent (24%). Both foams are combined and foamed to a total of 2100 ml. The composition is applied 2.5 mm thick to a woven viscose fiber fabric (1×3 mm mesh width) and coagulated at 47° C. After patterning, the product is predried and the reverse side of the woven viscose fiber fabric is coated, coagulated, and patterned in the same manner. After drying at 130° C., the product is vulcanized at 150° C., then washed and dried again.

The sponge cloth obtained from this Example has particularly favorable property combinations. The material is very soft and has a pleasant feel, with good strength and a highly open-pored structure, and its weight per unit of area is low. It can be boiled in laundering without deterioration of structure and strength.

EXAMPLE 6

180 g latex mixture as in Example 5 are added unfoamed to 399 g of a fiber suspension which was foamed to 1000 ml. The fiber mixture contains 25% cotton powder, 25% viscose fiber powder, 25% cellulose, 10% 5.6/8 viscose fibers cut short and 15% 3.3/8 polyester fibers cut short. The latex-compound and fiber-foam mixture is foamed to 2150 ml. The compound is applied, dried and vulcanized as in Example 5. The feel of the material is a little harder than that obtained in Example 5 and is characterized by great tear strength with a very low weight per unit of area.

The accompanying table summarizes various characteristics of the planar structures prepared in each of the above examples.

TABLE SUMMARIZING VARIOUS CHARACTERISTICS OF PLANAR STRUCTURE PREPARED IN EACH EXAMPLE

| Material Property | Unit | Example 1 | Example 2 | Example 3 | Example 4 | Example 5 | Example 6 |
|---|---|---|---|---|---|---|---|
| Thickness | mm | 4 | 4 | 4 | 4 | 4 | 4 |
| Weight per unit of area | g/m$^2$ | 423 | 752 | 454 | 289 | 400 | 283 |
| Density | g/cm$^3$ | 0.106 | 0.188 | 0.114 | 0.072 | 0.100 | 0.071 |
| Maximum pulling force | | | | | | | |
| Lengthwise | N/100 mm | 36 | 86 | 41 | 29 | 70 | 94 |
| Transverse | N/100 mm | 42 | 91 | 60 | — | 34 | 49 |
| Elongation at max. pull | | | | | | | |
| Lengthwise | % | 28 | 27 | 31 | 28 | 10 | 19 |
| Transverse | % | 29 | 24 | 28 | — | 10 | 21 |
| Water absorption per DIN 53923 | % | 413 | 257 | 310 | 400 | 378 | 289 |

The invention has been described in terms of specific embodiments set forth in detail, but it should be understood that those are by way of illustration only, and that the invention is not necessarily limited thereto. Modifications and variations will be apparent from this disclosure and may be resorted to without departing from the spirit of this invention, as those skilled in this art will readily understand. Accordingly, such variations and modifications of the disclosed products and methods are considered to be within the purview and scope of this invention and the following claims.

What is claimed is:

1. A method for the manufacture of a pore permeated absorbent, planar structure resembling natural sponge comprising:

(a) preparing a fiber mixture in the form of an aqueous suspension;

(b) mixing a foamable, heat-coaguable latex mixture with said fiber suspension;

(c) foaming said mixture by the introduction of a gaseous medium;

(d) applying said foamed mixture to one or both sides of a substrate:

(e) coagulating the fiber-containing latex foam by the application of heat to provide an open-pore structure; and, as the next step of said process;

(f) stabilizing said open-pore structure by drying and vulcanizing or curing to provide said pore-permeated absorbent structure.

2. A method according to claim 1 wherein, as a final step, the stabilized planar structure is rinsed and dried again.

3. A method according to claim 1 wherein the gaseous medium is air.

4. A method according to claim 1 wherein the substrate is a non-adhesive substrate.

5. A method according to claim 1 wherein the substrate is selected from the group consisting of a woven material, knit material, a layer of viscose foamed plastic, non-woven fabric, and abrasive fleece.

6. A method according to claim 5 wherein the foam is applied as a thick layer to one side of an abrasive fleece in turn comprising various synthetic fibers, binders and abrasives.

7. A method according to claim 1 wherein the aqueous fiber suspension is foamed with air to a density of about 200 to about 500 grams/liter and the latex suspension is added thereto, unfoamed.

8. A method according to claim 1 wherein the latex suspension is foamed with air to a density of about 200 to about 600 grams/liter and the fiber suspension is added thereto, unfoamed.

9. A method according to claim 1 wherein the fiber mixture in aqueous suspension comprises hydrophilic, absorbent fibers and hydrophobic, sort-cut fibers, said absorbent fibers being selected from the group consisting of cotton powder, linters, viscose fiber powder, viscose fibers cut short, cellulose, mechanical wood pulp, polyvinyl alcohol fibers and combinations thereof, and said hydrophobic, short-cut fibers being selected from the group consisting of polyamide, polyester, polypropylene, and polyacrylonitrile fibers, and the mixture being in an aqueous suspension characterized by a concentration of about 5 to about 30 percent by weight fiber mixture, based on the total weight of the suspension.

10. A method according to claim 9 wherein the aqueous suspension is characterized by a concentration of about 10 percent by weight fiber mixture.

11. A method according to claim 1 wherein the fiber/latex ratio ranges from about 80:20 to about 10:90 percent by weight.

12. A method according to claim 11 wherein the fiber/latex ratio ranges from about 70:30 to about 40:60 by weight.

13. A method according to claim 1 wherein the latex material includes about 5 to about 40 percent by weight of fillers selected for example from the group consisting of chalk and kaolin.

14. The method according to claim 1 wherein said aqueous fiber suspension contains a wetting agent and said aqueous suspension and said latex are foamed prior to being mixed and said mixture is further foamed in step (c).

15. A method according to claim 1 wherein the fiber mixture in aqueous suspension comprises hydrophilic, absorbent fibers and hydrophobic, short-cut fibers and the mixture being in an aqueous suspension characterized by a concentration of about 5 to about 30% by weight fiber mixture, based on the total weight of the suspension.

* * * * *

UNITED STATES PATENT AND TRADEMARK OFFICE

CERTIFICATE OF CORRECTION

PATENT NO. : 4,559,243

DATED : December 17, 1985

INVENTOR(S) : Passler, Michael; and Reisch, Bruno

It is certified that error appears in the above-identified patent and that said Letters Patent is hereby corrected as shown below:

Column 1, line 21, change "parctical" to --practical.

Column 3, line 16, change "cross-endeed" to --cross-ended--.

Column 3, line 19, change "in a" to --in an--.

Column 3, line 65, change "fiber powder;" to --fiber power, --.

Column 6, line 12, change "EXAMPLE 2" to --EXAMPLE 5--.

Signed and Sealed this

*Twenty-second* Day of *July 1986*

[SEAL]

*Attest:*

DONALD J. QUIGG

*Attesting Officer*

*Commissioner of Patents and Trademarks*